US005268969A

United States Patent [19]

Duran, Jr.

[11] Patent Number: 5,268,969

[45] Date of Patent: Dec. 7, 1993

[54] GUTTER BAG

[76] Inventor: Robert Duran, Jr., 13502 N. Burrrough #815, Houston, Tex. 77067

[21] Appl. No.: 723,845

[22] Filed: Jul. 1, 1991

[51] Int. Cl.[5] ..... B65D 33/14

[52] U.S. Cl. ..... 383/22; 383/23; 383/66; 383/67; 248/100; 220/404

[58] Field of Search ..... 383/66, 67, 22, 12, 383/24, 33; 220/403, 404; 248/100; 224/231, 42.46 R, 42.46 B

[56] References Cited

U.S. PATENT DOCUMENTS

| | | | |
|---|---|---|---|
| 1,657,790 | 1/1928 | Colliton | 383/23 |
| 2,128,689 | 8/1938 | Bingham | 383/66 X |
| 2,257,058 | 9/1941 | Johnson et al. | 248/100 |
| 2,305,863 | 12/1942 | Ginter | 428/100 |
| 2,431,452 | 11/1947 | Barkl | 383/23 X |
| 2,432,845 | 12/1947 | Wing | 383/67 X |
| 2,740,445 | 4/1956 | Fornell | 383/67 X |
| 2,798,650 | 7/1957 | Durham | 383/22 X |
| 3,888,486 | 6/1975 | Sutter et al. | 383/22 X |
| 3,973,376 | 8/1976 | Suominen . | |
| 4,050,492 | 9/1977 | Veilleux | 383/23 X |
| 4,139,037 | 2/1979 | McGuigan | 248/100 X |
| 4,250,990 | 2/1981 | Casper . | |
| 4,516,267 | 5/1985 | Kent et al. . | |
| 4,531,637 | 7/1985 | Cusmana . | |
| 4,674,127 | 6/1987 | Yamada et al. | 383/22 X |
| 4,764,028 | 8/1988 | Wood et al. . | |
| 4,773,585 | 9/1988 | Lehrman | 383/23 X |
| 4,805,969 | 2/1989 | Heacock . | |
| 4,859,084 | 8/1989 | Kaumeyer . | |
| 4,955,981 | 9/1990 | Provost . | |
| 5,071,003 | 12/1991 | Freelander | 383/22 X |

*Primary Examiner*—Allan N. Shoap
*Assistant Examiner*—Jes F. Pascua
*Attorney, Agent, or Firm*—Kenneth A. Roddy

[57] ABSTRACT

A hang bag for suspension from a rain gutter to receive and contain rain gutter debris. The hang bag has a generally arcuate bow-shaped frame with a straight side portion covered by a pad and a pair of upstanding curved hooks and a pair of handles. A flexible bag having an open top end is received and releasably engaged on the frame. The hooks are received on the open top end of a conventional rain gutter and releasably and slidably engage the open top end of the rain gutter and suspend the frame in a substantially horizontal position, and the pad is engaged on the outer wall of the rain gutter to maintain the bag in a generally vertical position. In a preferred embodiment, the bag has an opening along one side provided with a zipper to facilitate emptying the bag. Optionally, a trash bag can be placed inside the outer bag to serve as a removable liner. A user can place the hang bag on the rain gutter and remove the gutter debris from the gutter and place it in the hang bag. After one section of the gutter has been cleaned, the user can then slide, or lift and move the hang bag to the next section to be cleaned, and the process continues until the gutter is clean. The hang bag is easily lifted off the gutter and emptied.

9 Claims, 3 Drawing Sheets

GUTTER BAG

BACKGROUND OF THE INVENTION

1. Field of the Invention

This invention relates generally to apparatus for cleaning out rain gutters, and more particularly to a hang bag which is movably suspended from a rain gutter when cleaning a gutter to receive and contain debris from the gutter.

2. Brief Description of the Prior Art

Homeowners and general contractors commonly clean out rain gutters. To the knowledge of the inventor, no convenient device has been made commercially available for this method of gutter cleaning.

The usual method of cleaning rain gutter is for the laborer to manually remove the debris and throw it on the ground. Then after the gutter has been cleaned, the laborer had to rake up and bag the debris. This method is time consuming and labor intensive. Other disadvantages of this method is that the gutter debris often falls into swimming pools, flower beds, gardens, and onto cars. There is also the possibility of injury to persons in the work area, such as children playing.

To the knowledge of the inventor, there is no prior art that is particularly relevant to this invention. This conclusion is based on the results of a patent search that was conducted and directed toward bags equipped with suspension devices.

Some of the patents found in this search are as follows: Suominen, U.S. Pat. No. 3,973,376; Bumgarner, U.S. Pat. No. 4,201,299; Casper, U.S. Pat. No. 4,250,990; Kent, U.S. Pat. No. 4,516,267; Cusmano, U.S. Pat. No. 4,531,637; Wood, U.S. Pat. No. 4,764,028; Heacock, U.S. Pat. No. 4,805,969; Chasen, U.S. Pat. No. 4,993,583; Kaumeyer, U.S. Pat. No. 4,859,084; and Provost, U.S. Pat. No. 4,955,981.

Wing, U.S. Pat. No. 2,432,845 discloses a bobbin receiver having a bent rod frame with a laterally extending horizontal support section held in a fixed position on a loom frame by a clamp. A cloth bag having a hem at the open top end which surrounds the bars of the frame is secured to the frame. The open end of the bag is held at an incline so that the mouth will be inclined angularly downward to receive bobbins descending along a chute.

Sutter el al, U.S. Pat. No. 3,888,486 discloses a trash receptacle having a flat rectangular support bracket for mounting on a flat surface and a sheet metal ring welded to the support bracket which has a series of circumferentially spaced hooks extending radially outward from the ring. A bag of see-through woven construction has a reinforced upper band with a series of loops which are looped over the hooks of the ring. The bag has an opening in the side with an overlapping flap portion or snaps. Alternatively, a hood is received over the open end of the metal ring to serve as a target. The trash receptacle is similar to a closed end basketball hoop and net wherein the circular metal ring serves as a target for throwing articles into the bag.

Johnson et al, U.S Pat. No. 2,257,058 discloses a bag holder which has a C-shaped hoop frame formed of strap iron with the ends twisted at right angles and bent to provide U-shaped hooks or brackets which engage the edge of a fruit bin. The hoop of the frame has projections extending laterally outward which pass through the meshes of a mesh fruit bag to retain the bag on the hoop when bagging fruit.

None of the above patents have the structural and utilitarian features of the present invention and are not suitable to be suspended from a rain gutter to receive and contain debris from the gutter.

The present invention is distinguished over the prior art in general, and these patents in particular by a hang bag for suspension from a rain gutter to receive and contain rain gutter debris. The hang bag has a generally arcuate bow-shaped frame with a straight side portion covered by a pad and a pair of upstanding curved hooks and a pair of handles. A flexible bag having an open top end is received and releasably engaged on the frame. The hooks are received on the open top end of a conventional rain gutter and releasably and slidably engage the open top end of the rain gutter and suspend the frame in a substantially horizontal position, and the pad is engaged on the outer wall of the rain gutter to maintain the bag in a generally vertical position. In a preferred embodiment, the bag has an opening along one side provided with a zipper to facilitate emptying the bag. Optionally, a trash bag can be placed inside the outer bag to serve as a removable liner. A user can place the hang bag on the rain gutter and remove the gutter debris from the gutter and place it in the hang bag. After one section of the gutter has been cleaned, the user can then slide, or lift and move the hang bag to the next section to be cleaned, and the process continues until the gutter is clean. The hang bag is easily lifted off the gutter and emptied.

SUMMARY OF THE INVENTION

It is therefore an object of the present invention to provide a gutter bag which will significantly reduce the time and labor involved in cleaning out rain gutters.

It is another object of this invention to provide a gutter bag which will greatly reduce the possibility of injury to persons in the area where rain gutters are being cleaned of debris.

Another object of this invention is to provide a gutter bag which will prohibit rain gutter debris from entering swimming pools, flower beds, and gardens, and prevent debris from falling onto cars.

Another object of this invention is to provide a gutter bag which will eliminate extra labor to remove rain gutter debris from swimming pools, flower beds, gardens, and cars and other areas where it may fall using prior art methods of rain gutter cleaning.

Another object of this invention is to provide a gutter bag for cleaning rain gutters which will eliminate the need to rake and bag debris removed from the gutter.

A further object of this invention is to provide a gutter bag which will make the task of cleaning debris from rain gutters much easier.

A still further object of this invention is to provide a gutter bag which will hold a bag open for easy access during yard work.

Other objects of the invention will become apparent from time to time throughout the specification and claims as hereinafter related.

The above noted objects and other objects of the invention are accomplished by a hang bag for suspension from a rain gutter to receive and contain r in gutter debris. The hang bag has a generally arcuate bow-shaped frame with a straight side portion covered by a pad and a pair of upstanding curved hooks and a pair of handles. A flexible bag having an open top end is received and releasably engaged on the frame. The hooks are received on the open top end of a conventional rain gutter and releasably and slidably engage the open top end of the rain gutter and suspend the frame in a substantially horizontal position, and the pad is engaged on the outer wall of the rain gutter to maintain the bag in a generally vertical position. In a preferred embodiment, the bag has an opening along one side provided with a zipper to facilitate emptying the bag. Optionally, a trash bag can be placed inside the outer bag to serve as a removable liner. A user can place the hang bag on the rain gutter and remove the gutter debris from the gutter and place it in the hang bag. After one section of the gutter has been cleaned, the user can then slide, or lift and move the hang bag to the next section to be cleaned, and the process continues until the gutter is clean. The hang bag is easily lifted off the gutter and emptied.

DESCRIPTION OF THE PREFERRED EMBODIMENT

Figure 1:
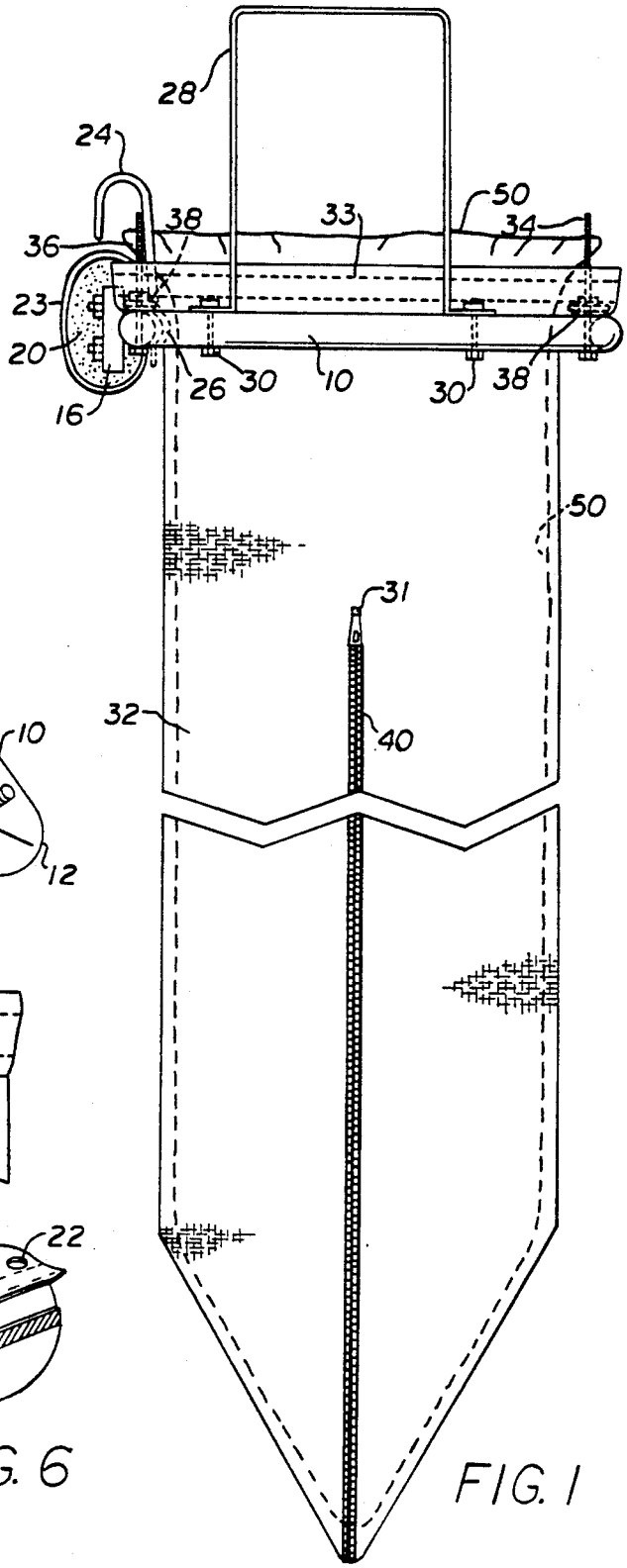
FIG. 1 is a left side elevation view of a gutter bag in accordance with the present invention.
Figure 2:
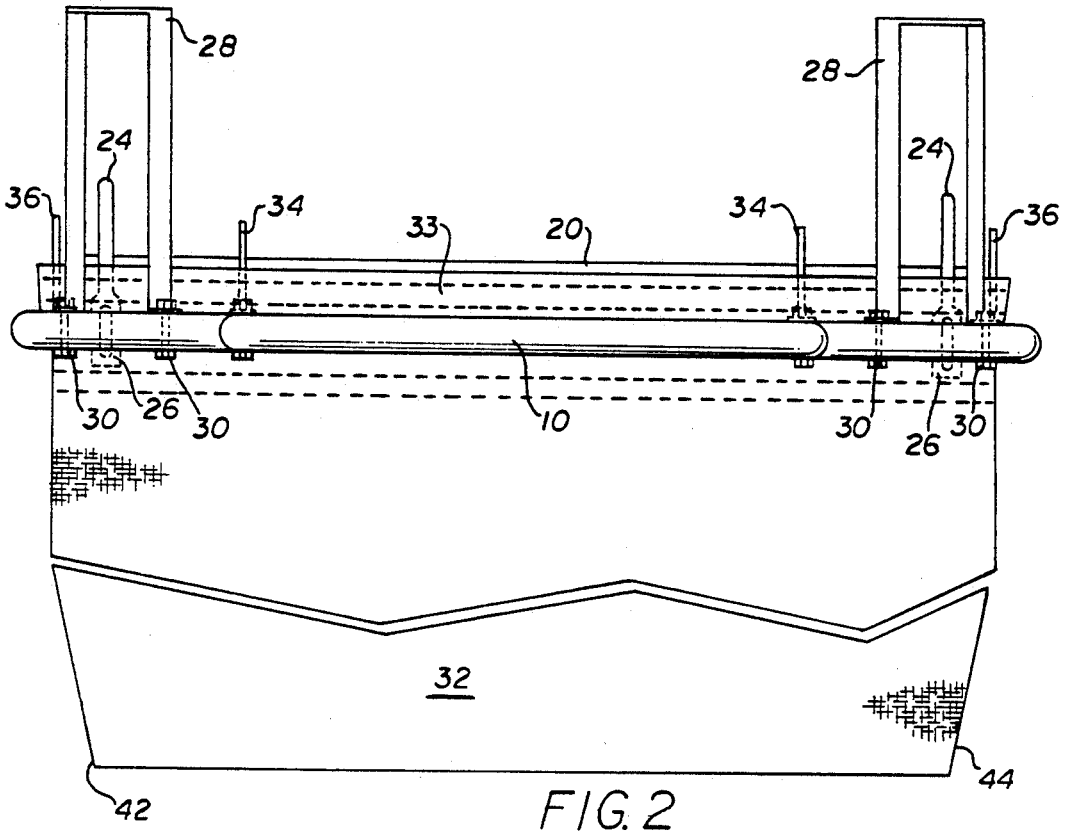
FIG. 2 is a front elevation view of the gutter bag.
Figure 3:
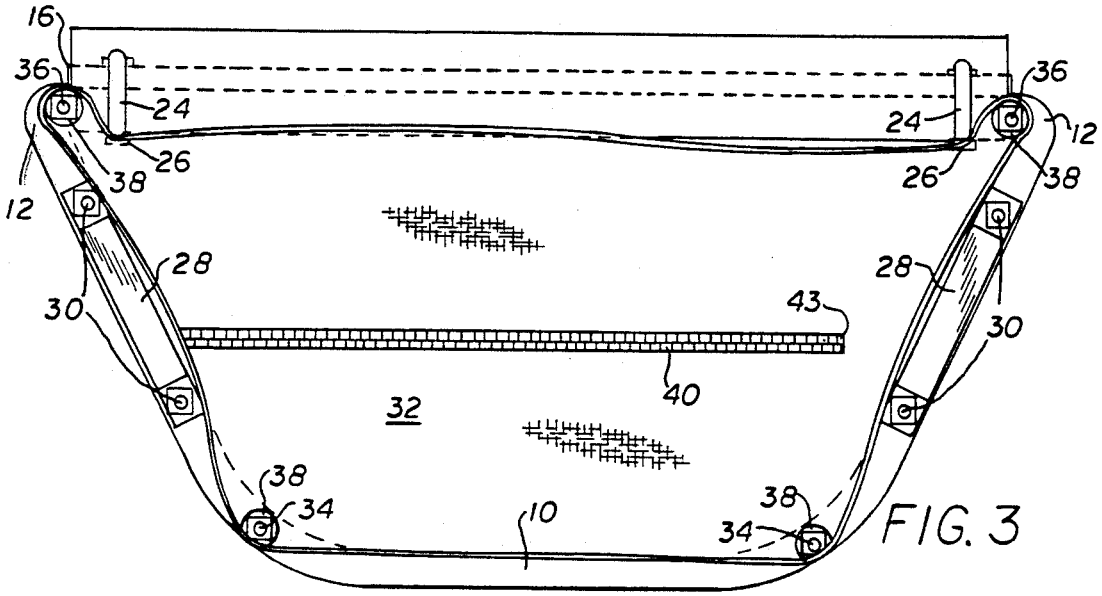
FIG. 3 is a top plan view of the gutter bag showing how the bag is given tension by stretching it around the hook members of the frame.

Referring to the drawings by numerals of reference, a preferred embodiment of a gutter bag is shown from the side in FIG. 1, from the front in FIG. 2, and from the top in FIG. 3. The gutter bag has a tubular frame 10 made of light weight tubing formed into an arcuate bow shape having laterally opposed ends 14 and rear corners 12 (FIG. 3). The preferred tubular frame 10 is formed of steel tubing approximately 2 cm in diameter and 21 om long and bent such that the opposed ends are approximately 41 cm apart.

Figure 4:
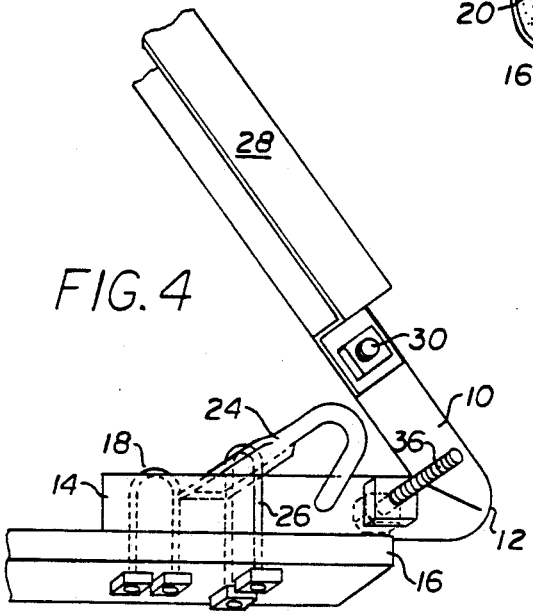
FIG. 4 is a partial top perspective view of one corner of the gutter bag showing the details of construction.

As best seen in FIGS. 1 and 4, a rectangular strip of wood lath 16 is mounted by lath mounting bolts 18 to the ends 14 of the frame 10 and extends between the ends 14 and rear corners 12 of the frame. In the preferred embodiment, the wood lath 16 is approximately 1 cm×3.5 cm×59 cm and when mounted on the frame, the back side of the frame 10 between the rear corners 12 is about 64 cm long.

A pair of hooks 24 are mounted to the frame 10 approximately 7.5 cm inwardly from the rear corners 12 by hook mounted bolts 26. The preferred hooks 24 are made of steel and are approximately 15.5 cm long, and their curved upper ends extend outwardly over the wood lath 16 (FIG. 1).

Figure 6:
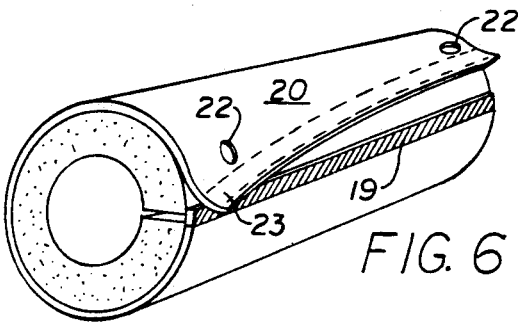
FIG. 6 is a perspective view of the pad of the gutter bag.

A pad 20 (FIG. 6) formed of resilient foam material 21 having an outer cover 23 is mounted around the wood lath 16 and the frame ends 14, as seen in FIGS. 1 and 6. The pad cover 23 may be made of canvas and has a hole 22 near each end. The pad cover 23 wraps around the foam material 21 and ends are releasably fastened with a fabric hook and loop fastener material secured to its edges, such as VELCRO made by Velcro USA, of Manchester, N.H.

A suitable pad 20 can be made using a handlebar pad known as a "BMX" pad. The term BMX is a well known abbreviation for "Bicycle Moto-Cross" which is the sport of bicycle racing on a dirt track. The "BMX" pad is a foam rubber pad having an outer cover which is installed on the handlebars and tubular frame members of the bicycle to prevent injury to the rider. A pad can also be formed using a polyethylene pipe insulator, such as that made by the "Frost King" brand manufactured by Thermwell Products Co., of Patterson, N.J. and Los Angeles, Calif.

As best seen in FIGS. 1, 2, and 4, a pair of handles 28 are mounted on the frame 10 by handle mounting bolts 30 and extend upwardly therefrom.

A pair of front and pair of rear bag mounting bolts 34 and 36, respectively, are mounted to the frame 10 near the front corners and rear corners 12 of the frame. As shown in FIGS. 1, 2, and 4, the rod-like shanks of the bolts 34 and 36 project upwardly from the tubular frame 10.

Figure 5:
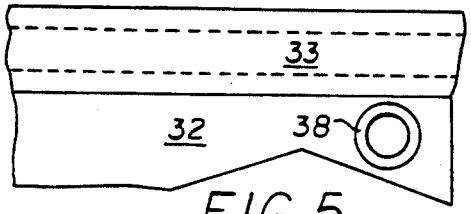
FIG. 5 is a partial elevation view of a portion of the bag member of the gutter bag showing the grommet and reinforcement stitching details.

A bag 32 having a main body portion (side wall), an enclosed bottom end, and an open top end, is removably mounted in the frame 10 and held by the bag mounting bolts 34 and 36. The bag 32 is preferably made of vinyl. As best seen in FIG. 5, the open top end of the bag 32 has a reinforcement hem 33 and is provided with grommets 38 which are received on the upwardly projecting shanks of the bag mounting bolts 34 and 36. The grommets 38 prevent the bag 32 from tearing away from the mounting bolts 34 and 36.

The bag 32 has an opening in the main body or side wall portion which is provided with a closure, such as a zipper 40 sewn on the edges of the opening. As seen in FIGS. 1 and 3, a preferred zipper 40 has a start 31 a distance below the open top end of the bag 32 and extends downwardly along the length of the bag side wall, around one corner 42, along the bottom and terminates near the opposed corner 44 of the bag. It should be understood that other suitable fasteners may be used in lieu of the zipper, such as snap fasteners or hook and loop fabric fasteners, such as VELCRO (Velcro USA, of Manchester, N.H.). The bag 32 may also be provided with drain holes in the bottom, and the drain holes may also be provided with grommets to prevent them from tearing.

Optionally. as shown in dotted line in FIG. 1, a commercially available flexible trash bag 50 may be placed inside the bag 32 and used as a removable liner. The trash bag would be placed inside the bag 32 with the open top end of the trash bag 50 extending above the frame and then overlapped over the upwardly projecting shanks of the bag mounting bolts 34 and 36 such that the bolts punch holes in the trash bag to hold it in place.

OPERATION

Figure 7:
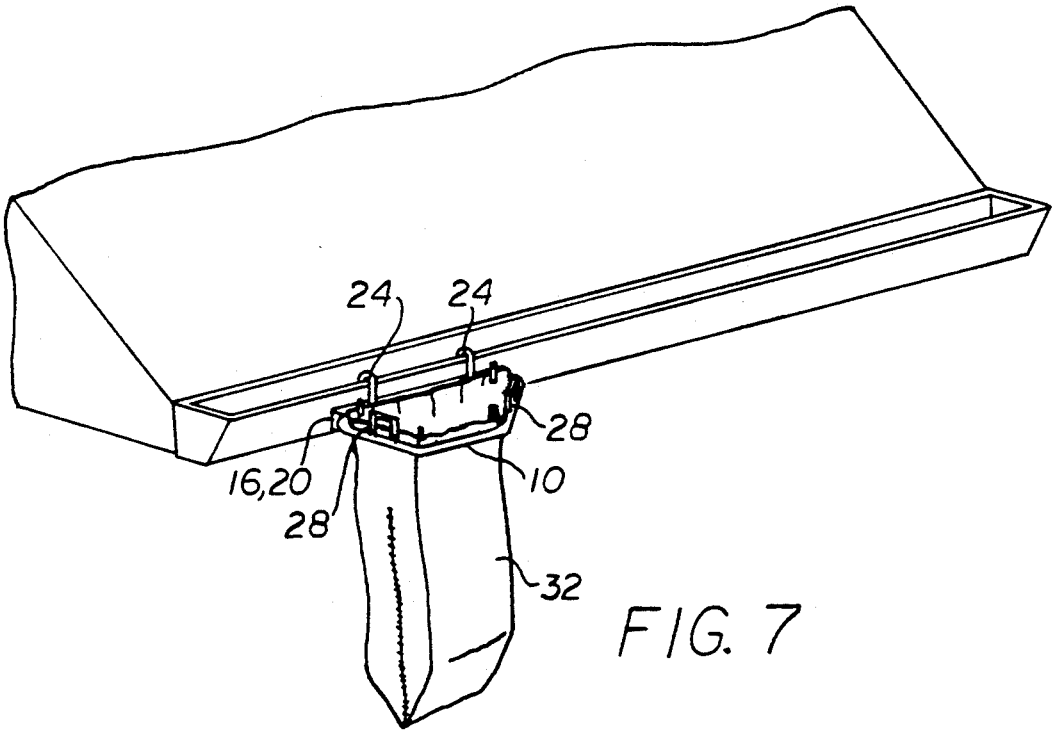
FIG. 7 is a perspective view showing the gutter bag placed on a conventional rain gutter.

As seen in FIG. 7, the gutter bag is shown placed on a conventional rain gutter. The hooks 24 are received in the open top end of the rain gutter and slidably suspend the gutter bag on the outer wall of the gutter in a horizontal position. The wood lath 16 and/or pad 20 engages the outer wall of the gutter and position the frame 10 such that the bag 32 is substantially vertical. The handles 28 allow the gutter bag to be slid along the length of the gutter, and facilitate lifting, transporting, and setting the gutter bag down. The arcuate bow shape of the frame 10 facilitates use of the gutter bag in tight corners and holds the top end of the bag 32 open for inserting debris from the rain gutter. The zipper 40 allows debris contained in the bag 32 to be easily removed, and can allow water to be drained from the bag.

After the gutter bag has been placed in the rain gutter, the user can then manually remove the gutter debris from the gutter and place it in the gutter bag. After one section of the gutter has been cleaned, the user can then slide, or lift and move the gutter bag to the next section to be cleaned, and the process continues until the gutter is clean. If the bag gets about three quarters full, it can be lifted off the gutter and emptied by turning it upside down or unzipping the zipper and emptying the contents in a suitable container. If the trash bag liner is used, the top end of the trash bag can be tied and can be removed form the outer bag by lifting it out or by unzipping the zipper.

While this invention has been described fully and completely with special emphasis upon a preferred embodiment, it should be understood that within the scope of the appended claims the invention may be practiced otherwise than as specifically described herein.

For example, the frame and suspension members may manufactured as a single unit and made of different materials, and may be shaped in different configurations. The pad may also be formed as an integral unit and/or made of different materials. The bag may also be provided in various other shapes.

I claim:

1. A hang bag to be suspended on a rain gutter when cleaning the gutter to receive and contain rain gutter debris, the rain gutter being of the type having a generally U-shaped cross section with an open top end, a longitudinal inner and outer side wall, and a longitudinal bottom wall, the hang bag comprising:

a generally arcuate fame of rigid tubular material having a straight side portion to reside closely adjacent the longitudinal outer side wall of the rain gutter;

hook mean son said frame to releasably and slidably engage the open top end of the rain gutter and suspend said frame in a substantially horizontal position;

a pad member on said frame straight side portion sized to engage the outer side wall of the rain gutter and bias said frame generally perpendicular to the outer side wall of the rain gutter;

bag mounting means on said frame configured to receive and releasably engage an open top end of a bag;

a flexible bag having an open top end, a longitudinal side wall body portion , and a bottom end, said open top end received and releasably engaged on said bag mounting means and said longitudinal side wall body portion disposed generally vertical when said frame is engaged on the rain gutter; and an opening on said flexible bag longitudinal side wall body portion extending generally longitudinally along the length of said longitudinal side wall body portion to facilitate emptying said bag.

2. The hang bag according to claim 1 including handle means on said frame shaped to receive the hand of the user for sliding said frame relative to the rain gutter and lifting and transporting said bag.

3. The hang bag according to claim 1 in which said hook means include at least one hook member on said frame configured to releasably and slidably engage the open top end of the rain gutter.

4. The hang bag according to claim 1 in which said pad member is formed of resilient material.

5. The hang bag according to claim 1 including releasable closure means on said opening on said flexible bag longitudinal side wall body portion to selectively secure said opening in a closed condition.

6. The hang bag according to claim 1 in which said opening on said flexible bag longitudinal side wall body portion extends generally longitudinally along the length of said longitudinal side wall body portion and along a portion of said bottom end of said bag.

7. The hang bag according to claim 1 in which said bag mounting means include rod-like projections on said frame, and said flexible bag open top end is configured to be received and releasably engaged on said rod-like projections.

8. The hang bag according to claim 7 in which said bag open top end has grommets thereon to be slidably received and releasably engaged on said rod-like projections.

9. The hang bag according to claim 1 in which said bag and said bag mounting means removably receive a disposable flexible trash bag which is placed inside the first said flexible bag and releasably engaged on said bag mounting means to serve as a removable liner.

* * * * *